US011618621B2

(12) United States Patent
McCormick

(10) Patent No.: US 11,618,621 B2
(45) Date of Patent: Apr. 4, 2023

(54) TRULY TAMPER-EVIDENT CONTAINER

(71) Applicant: Richard John McCormick, Newport Beach, CA (US)

(72) Inventor: Richard John McCormick, Newport Beach, CA (US)

(73) Assignee: Rick McCormick, Newport Beach, CA (US)

( * ) Notice: Subject to any disclaimer, the term of this patent is extended or adjusted under 35 U.S.C. 154(b) by 413 days.

(21) Appl. No.: 16/810,059

(22) Filed: Mar. 5, 2020

(65) Prior Publication Data

US 2021/0276770 A1 Sep. 9, 2021

(51) Int. Cl.
*B65D 51/22* (2006.01)
*B65D 55/06* (2006.01)

(52) U.S. Cl.
CPC ..... *B65D 51/222* (2013.01); *B65D 55/06* (2013.01); *B65D 2251/0093* (2013.01); *B65D 2401/15* (2020.05)

(58) Field of Classification Search
CPC ..... B65D 51/222; B65D 55/06; B65D 2251/0093; B65D 2401/15
USPC ..... 215/230, 232, 250, 253; 222/556; 220/254.3, 254.5
See application file for complete search history.

(56) References Cited

U.S. PATENT DOCUMENTS 4,181,246 A 1/1980 Norris
4,487,324 A * 12/1984 Ostrowsky ..... B65D 47/0814 215/253
4,711,372 A * 12/1987 Gach ..... B65D 47/0885 222/23
4,984,700 A * 1/1991 Knickerbocker ..... B65D 51/18 215/250
5,012,940 A * 5/1991 Koehn ..... B65D 55/06 215/253
5,012,941 A * 5/1991 Abrams ..... B29C 65/665 215/250
5,036,889 A * 8/1991 Pherigo ..... B65D 47/0838 222/107
6,082,568 A * 7/2000 Flanagan ..... B65D 51/20 222/153.07
8,439,212 B2 * 5/2013 Clodfelter ..... B65D 51/18 215/253
8,499,950 B2 8/2013 Win
9,199,771 B2 12/2015 Kasper
9,309,032 B2 4/2016 Berge et al.
9,321,567 B2 4/2016 Daggett et al.
9,340,335 B2 5/2016 Ellenkamp-Van Olst et al.
9,402,782 B2 8/2016 Browne
9,499,313 B2 11/2016 Zhong et al.
(Continued)

*Primary Examiner* — James N Smalley

(57) ABSTRACT

One embodiment of a vertical tube (26) for an improved tamper-evident container having no threads which descends from the underside of a cap (12) and is permanently adhered to a receiving cylindrical, threadless body neck (50) on the top of the body (10). A tape (46) is adhered to the underside of the lid (14) and runs towards the front of the cap where the opening is located, extends down to a plateau (22) where it runs back towards the rear, hinged (18) end of the cap. The tape breaks apart when the lid is opened for the first time. The cap and lid are clear and see-through which allows the customer to see if the tape is torn apart and know whether the product has been tampered with or not. Other embodiments are described and shown.

16 Claims, 10 Drawing Sheets

(56) References Cited

U.S. PATENT DOCUMENTS

| | | | | |
|---|---|---|---|---|
| 9,624,008 | B2 | 4/2017 | Thorstensen-Woll et al. | |
| 9,650,185 | B2 * | 5/2017 | Kieffer | B65D 47/0838 |
| 9,701,451 | B2 | 7/2017 | Skillin et al. | |
| 9,708,105 | B2 | 7/2017 | McPherson | |
| 9,758,281 | B2 | 9/2017 | Glaser et al. | |
| 9,776,350 | B2 | 10/2017 | Witt | |
| 9,790,011 | B2 | 10/2017 | Rosenquist | |
| 9,815,603 | B2 | 11/2017 | Bannini | |
| 9,878,831 | B2 | 1/2018 | Danielsson et al. | |
| 9,914,576 | B2 | 3/2018 | Konicke | |
| 9,963,274 | B2 | 5/2018 | Brunner | |
| 9,963,281 | B2 | 5/2018 | Bratsch | |
| 10,040,608 | B2 | 8/2018 | Olson et al. | |
| 10,131,477 | B2 | 11/2018 | Robert et al. | |
| 10,138,030 | B2 | 11/2018 | Orszullok | |
| 10,138,035 | B2 | 11/2018 | Loukov | |
| 10,196,191 | B2 | 2/2019 | Torrent Ortega | |
| 10,214,325 | B2 | 2/2019 | Rognard et al. | |
| 10,232,977 | B2 | 3/2019 | Dahl et al. | |
| 10,239,667 | B2 | 3/2019 | Price | |
| 10,246,230 | B2 | 4/2019 | Sangiovanni | |
| 10,259,626 | B2 | 4/2019 | Thorstensen-Woll | |
| 10,351,315 | B2 | 7/2019 | Berge | |
| 10,377,540 | B2 | 8/2019 | Borgardt et al. | |
| D859,153 | S | 9/2019 | Ramsuer et al. | |
| D859,154 | S | 9/2019 | Skillin | |
| 10,427,822 | B2 | 10/2019 | Viale et al. | |
| 10,435,198 | B2 | 10/2019 | Turcotte | |
| 10,464,726 | B2 | 11/2019 | Rognard | |
| 10,486,867 | B2 | 11/2019 | Graybill et al. | |
| 10,494,159 | B2 | 12/2019 | Kneer et al. | |
| 10,597,201 | B2 | 3/2020 | Price | |
| 10,625,912 | B2 | 4/2020 | Schmid | |
| 10,669,083 | B2 | 6/2020 | McPherson | |
| D889,263 | S | 7/2020 | Scharf | |
| 10,882,666 | B2 | 1/2021 | Giraud et al. | |
| D909,871 | S | 2/2021 | Enemark | |
| 10,913,580 | B2 | 2/2021 | Browne | |
| 10,926,923 | B2 | 2/2021 | Berroa Garcia | |
| 10,934,063 | B2 | 3/2021 | Benoit-Gonin et al. | |
| 10,945,508 | B2 | 3/2021 | Wei | |
| 10,947,015 | B2 | 3/2021 | Smith | |
| D915,199 | S | 4/2021 | Berge et al. | |
| 10,974,884 | B2 | 4/2021 | Van Der Molen | |
| 10,994,897 | B2 | 5/2021 | Salcido Pinera | |
| 11,046,490 | B2 | 6/2021 | Cerveny | |
| 11,072,473 | B2 | 7/2021 | Rossi | |
| 11,091,310 | B2 | 8/2021 | Meaux et al. | |
| 11,186,414 | B2 | 11/2021 | Finch | |
| 11,208,238 | B2 | 12/2021 | Conaway | |
| 11,214,414 | B2 | 1/2022 | Berge et al. | |
| D949,690 | S | 4/2022 | Hiltzer et al. | |
| 11,383,904 | B2 | 7/2022 | Rivelli | |
| 2001/0050291 | A1 * | 12/2001 | Jud | B65D 47/08 222/546 |
| 2008/0047976 | A1 * | 2/2008 | Scheer | B65D 47/0809 222/153.06 |
| 2017/0015459 | A1 * | 1/2017 | Warner | B65D 55/06 |
| 2019/0127133 | A1 * | 5/2019 | Rossi | B65D 35/44 |
| 2019/0231971 | A1 * | 8/2019 | Verlaak | B65D 77/2024 |

* cited by examiner

TRULY TAMPER-EVIDENT CONTAINER

BACKGROUND OF THE INVENTION

This invention relates to product packaging, specifically, the tamper-proofing of product containers.

Man has always required various storage containers for transporting and holding various goods such as water, wine, grains, precious metals, etc. Different goods required different types of containers (pots, bottles, etc.), but they were often large and made of heavy materials which made the cost of transportation very expensive and difficult, and, due to insufficient securities in place such as weak locks, the materials used (ivory, shellac, or rubber), lack of surveillance systems, etc., could easily be stolen, broken into, or tampered with.

The Tylenol scare in the early 1980s was an eye-opener for everyone throughout the world, especially for the manufacturers of pharmaceutical products that are taken orally. The sabotaging of eye drop products, as well as numerous other copycat product-tampering crimes, forced the public to demand safer packaging that could not be tampered with. With the onslaught of numerous lawsuits against manufacturers, companies responded with new protections (safety shrink bands, glued outer packaging cartons, tape strips, etc.) to serve as inexpensive early warning systems to let customers know if a product may have been tampered with.

Consumers have always wanted reliable, high-quantity products that are inexpensive and easy to use. The manufacturers, with the fear of lawsuits and their reputations on the line, try to accommodate the consumers in this regard while trying to make the packaging unencumbering and safe to use, all while trying to keep their manufacturing costs to a minimum. They could make their packaging safe out of heavy, expensive materials, such as steel or glass, but the costs would be prohibitive and not convenient for their customers. If they are made of cheap materials with poor designs and construction, they risk having products that may be easily tampered with. Where is the balance of safety and convenience at a reasonable cost? This is the dilemma the manufacturers face.

Back in 1841, an American portrait painter named John Rand needed containers for his messy paints, so he invented the squeezable metal tube or collapsible tube. In 1870, New Yorker Henry Palmer patented a screw-top collapsible container intended for the storage of condensed medicinal extracts. The screw-top collapsible container, collapsible tube or squeeze tube, is still very prevalent amongst today's products found in pharmacies throughout the world. They are inexpensive, lightweight, and easy to carry or transport.

In 1889, toothpaste in a tube was introduced by Johnson & Johnson. It is the most common item sold in collapsible tubes to this day and almost every household has at least a few collapsible tubes in their home. Collapsible tubes are just one of the many excellent candidates for tamper-evident containers.

A few collapsible tube closures or systems have been proposed—for example, in U.S. Pat. No. 10,435,198 to Turcotte (2019), U.S. Pat. No. 4,181,246 to Norris (1980), and Bray Pub. No.: US 2009/0065528 (2009 Mar. 12)/U.S. Provisional Pat. App No. 60/970,750, U.S. Pat. No. 9,499,313 to Zhong, et al, but they do not use a simple, cost-effective manner in which to keep potential saboteurs from perpetrating dastardly acts on product containers, many of which are pharmaceutical products to be taken orally or rubbed onto one's skin. This would include the region of the nose and mouth known as the "Danger Triangle of the Face."

These substances and medicines should carry the utmost protection from those who would want to cause harm or ill will by means of disfiguring another person's face, body, ruining their overall health, or, worse yet, the killing of the products' users.

Turcotte's patent, more or less, deals with maximizing the amount of space on the packaging, so as to increase the amount of space for advertising. Norris's "Closure for A Collapsible Tube" involves a collapsible tube container with a top which has a rotating spherical ball where the product dispenses from various ports. Bray's Tube Packaging System has the "head" lid section molded into the main body where the product is located, rather than most tube lids that are added as a second piece to the main body. Bray is going after a reduced number of components to reduce the cost of the tube, which is fine, but not if it's at the expense of the consumer's health, protection, and well-being, or the shareholders of a publicly-traded corporation with regard to the potential sabotage of the product's contents.

Zhong, et al. patent is, like many of the researched patents, very elaborate and involves a rotatable and removable cap that is mounted on a tube. It includes fixed wings, a safety outer ring, multiple safety pawls which are equally distributed on the inner side of the outer safety ring, and a ratchet tooth that, when engaged, won't allow reversible motion. Such intricate safety caps are usually cost-prohibitive to a manufacturer, and thus the customer, to whom the manufacturer would have to pass on this exorbitant cost.

The problem is that many of these products are in a competitive field, which includes generic brands once the patents expire, so the manufacturers are not in a position to pass on the high packaging costs to the customer. Many of these containers are not really tamper-evident as they are located on the outside of the container and can be taken off. There is no universal system of tamper-evident protection, so packaging varies from one product to another and this leaves the customer not knowing if there was supposed to be a tamper-evident tape or safety shrink band, etc. on the container, or not. The high-end, intricate, tamper-evident containers are cost-prohibitive and that is why many of them are not in use today. It comes down to a cost-versus-benefit analysis on the part of the manufacturers. They justify that the odds of someone tampering with their product and causing harm to someone is not likely, so they spend just enough to make the packaging safe enough to instill confidence in the customers.

Even to this day, many of the healthcare and personal hygiene consumer products are packaged in a way that is easily susceptible to sabotage. At a recent packaging trade show, it was pointed out that 30% of the safety shrink bands on packaging do not do their job as intended. They can be stretched, manipulated, or otherwise taken off without breaking off. Many containers have a cap that is screwed onto the container body. The only obstacle blocking a criminal with ill intent from slipping a foreign substance into the container is a piece of foil or paper covering the spout where the product exits. In fact, even to this day, numerous companies do not even use this foil or paper. Many people don't even check to see if the product has a piece of foil or paper protecting the contents. This would involve unscrewing the top in a retail store. How many people are going to do that? If there is no foil or paper covering the spout, how does the customer know if this is the standard operating procedure with how the manufacturer packages their product or not? Many customers assume there is nothing to be concerned about since so many manufacturers still make their products without the tamper-evident foil on the spout.

Anyone who wants to do ill will can simply unscrew the cap and put a foreign substance into the container. If there is a piece of foil covering the spout, anybody could simply lift the tabs on the foil and slip in a foreign substance, or keep the foil in place without lifting the pull tabs and puncture the foil using a hypodermic needle to inject, say, an acid. Then, they could simply place a piece of foil from an identical product on top. One could probably get away with simply leaving the needle puncture mark in the foil without anyone noticing as the odds of anybody noticing would be quite small. It's a numbers game. They could use a needle on a hundred packages and maybe only a few would be discovered.

For most products, each time the product is used, the cap must be unscrewed to get to the contents and then screwed back on once the product has been dispensed. This is a waste of time played out by people across the world each day. To save time, product designers came up with the flip-up lid, but this just added another entry point for saboteurs and are mostly for slow, gel-like-viscosity products like shampoo, lotions, and toothpaste. Most product packages, including those that have a screw-on cap, and/or a flip-up lid, are susceptible to sabotage. It is in everyone's best interest, both for consumers and the manufacturers, to make sure that all consumer product containers are made tamper-evident to reduce serious illness, injury, or death.

Today's consumer product containers suffer from a number of disadvantages:

(a) They can easily be tampered with simply by unscrewing the cap from the product body and adding a foreign substance through the spout. Many stores run skeleton crews on the sales floor which allows saboteurs to easily tamper with products without being discovered.

(b) They can easily be tampered with by simply peeling back a piece of "tamper-evident" tape located at the lid opening on the outside of the cap.

(c) The foil or paper covering the spout where the product exits can simply be peeled back, taken off entirely, have a new foil placed on top of, or in place of, the original foil after the product has been sabotaged by inserting a hypodermic needle, etc.

(d) There is no consistency with product protection from one company's products to another's. That is, some companies use foil to cover their spouts and some use nothing. If they don't all use the same universal protection system (all use foil covering the spout, a tape on the outside of the cap, safety shrink band, etc.), then how does the customer really know if the product has had these "tamperproof" items removed from the container or if the manufacturer never used them to begin with? How do customers know which "tamperproof" system is being applied by the different manufacturers if any? When a customer purchases an item, it's usually one "facing", that is, each unique item has one stock-keeping unit (SKU) on the counter shelf with the identical item directly behind it. The customer usually just picks out a product and sets it into their shopping basket or cart. He or she doesn't check to see how the other identical items lined up behind their product are protected (with a safety shrink band, outer tape, foil over the spout, etc.). The customer doesn't have the time to check every purchase they make at a store. Also, product packaging changes often, so what once may have been the product tamper-proofing system on a product, may have changed to an entirely unique tamper-proofing system the next time the customer purchases the same product.

(e) Very few of today's product containers have a clear, see-through cap and/or lid. If the customer can't see through to the spout foil (if there is one), how do they know whether the product has been tampered with, or not?

(f) Most, if not all, "tamper-evident safeguards" are located on the outside of the packaging where saboteurs have easy access to taking off, peeling back, stretching, altering, or removing these "protections" unbeknownst to the customer.

BRIEF SUMMARY OF THE INVENTION

In accordance with one embodiment, a product packaging container assembly comprises a tube in a clear, see-through cap, a body with a spout, and tape.

A number of advantages of my Truly Tamper-evident Container will become evident:

(a) The Truly Tamper-evident Container is difficult to defeat because it is inside the cap, so it is safer and gives a greater sense of confidence in the product to the customer.

(b) The customer can immediately know whether the product has been tampered with, or not, simply by looking through the clear cap at the safety cape to see if it is broken or not.

(c) It is more streamlined (by approximately 10%), so it uses fewer raw materials for the manufacturer and wastes less valuable shelf space for the retailer and consumer.

(d) Time saved for the consumer who no longer has to waste time screwing on and screwing off the cap each time they use the product (which is daily in many instances).

(e) Corporations will not have nearly as many lawsuits brought against them, due to the fact that their products will be much harder to tamper with.

(f) Customers will no longer have to open the lid before purchasing to see for themselves whether the product has been tampered with.

Accordingly, several advantages of one or more aspects are as follows: to provide product packaging containers that are truly simple and tamper-evident, quick to apply, greatly reduce/avoid injury or death to the consumer, have the public trust of the products with regard to the purity of their contents/ingredients, bring about goodwill for manufacturers who are proactive in combating the sabotage of their products, increased insurance of safety, better protection from lawsuits against manufacturers, retained or increased sales of name brands and generic brands due to a higher, newfound trust of manufacturers, shows manufacturers took good-faith effort/initiative in safely securing their products for their customers, lower lawsuit costs, reduced manufacturing costs due to fewer manufacturing steps which lead to higher margins, and a smaller, more streamlined cap, with potential savings, passed on to customers. These and other advantages of one or more aspects will become apparent from a consideration of the ensuing description and drawings.

BRIEF DESCRIPTION OF THE DRAWINGS

In the drawings, closely related figures have the same number but different alphabetic suffixes.

FIG. 4B has two breakaway points.

DRAWINGS REFERENCE NUMERALS

10 Body
12 Cap
14 Lid
16 Body Spout
18 Hinge
20 Crater
22 Plateau
24 Plateau Rim
26 Tube
28 Footing
30 Breakaway Point
32 Punch Hole
34 Thumb Dent
36 Dent Overhang
38 O-ring
40 Safety Shrink Band
42 Body Slope
44 Snap-off Studs
46 Safety Tape
48 Cap Spout
50 Body Neck
52 Safety Tape Fold
54 Sticky Side
56 Non-sticky Side
58 Safety Tape Sleeve
60 Inner Wall (of the lid)

DETAILED DESCRIPTION OF THE DRAWINGS

Figure 1A:
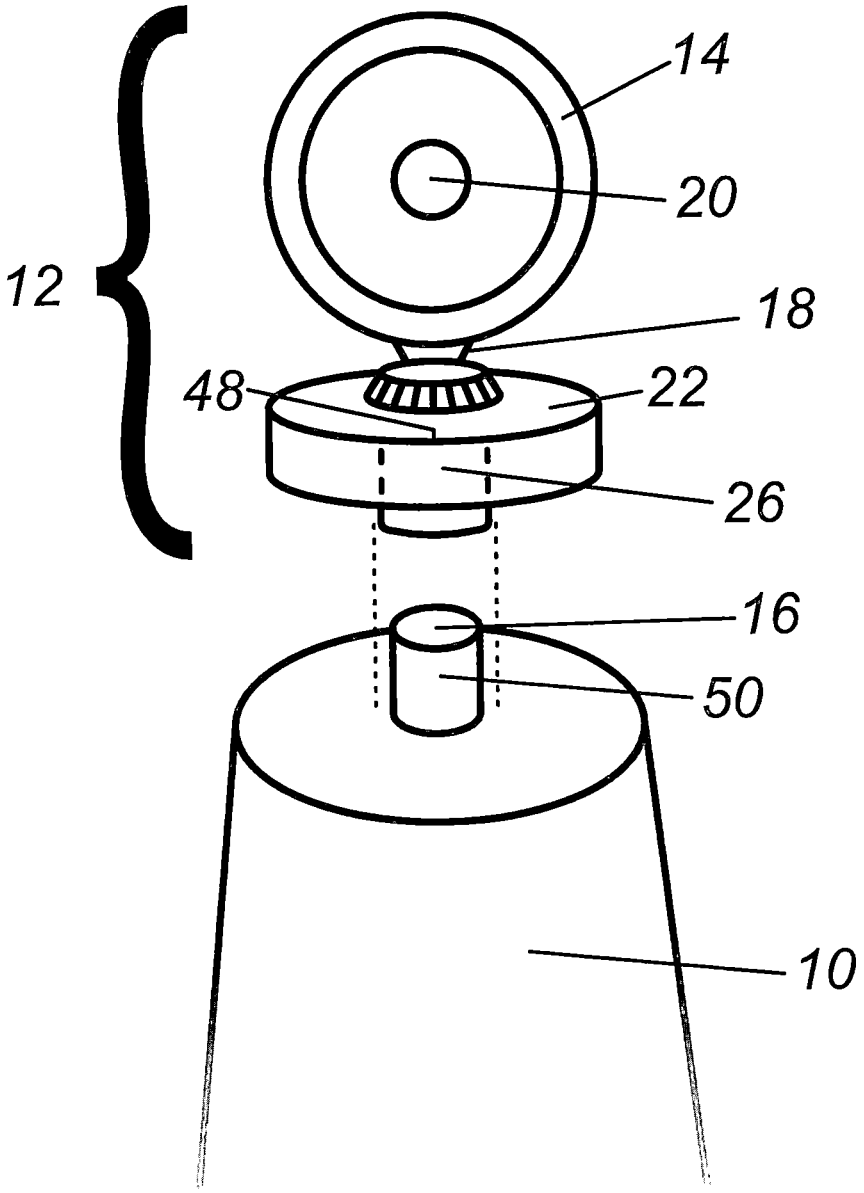
FIG. 1A is a front perspective view of a tamper-evident container with a tube of one embodiment.

One embodiment of the Truly Tamper-evident Container is illustrated in FIG. 1A (front view). The container is comprised of a cap (12) and a body (10), and can generally be made from a wide variety of plastics including polyethylene, high-density polyethylene (HDPE), low-density polyethylene (LDPE), polyethylene terephthalate (PET), etc., to hermetically seal and store such goods as shampoos, facial soaps, cosmetics, lotions, detergents, bleaches, motor oil, and numerous other products with varying degrees of viscosity. Steel, aluminum, and other metals can be used as well to store other contents such as paints and combustible liquids.

The cap (12) is clear and see-through which allows the customer to know immediately if the product about to be purchased has been tampered with or not. A screwless or threadless tube (26) is shown to descend vertically to an accepting screwless or threadless body neck (50). It could also be connected at a spout (16), brim, sides, or flanged top of the body. On the plateau (22) is a cap spout (48) where the product's contents, housed in the body (10), comes out.

Figure 2A:
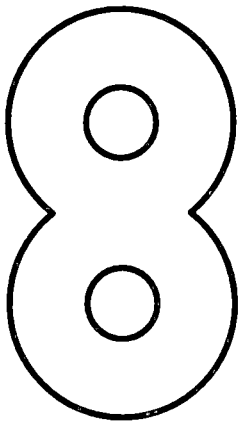
FIG. 2A is a flat, unfolded safety tape with no visible breakaway points and an average distance between the two punch holes of one embodiment.
Figure 2B:
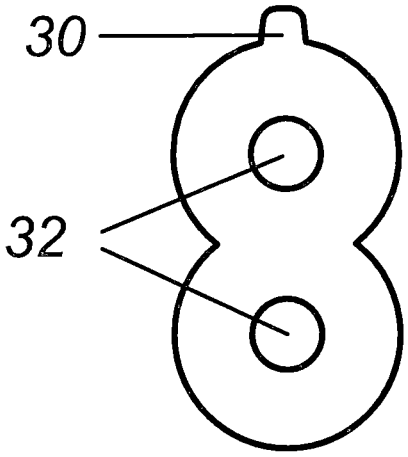
FIG. 2B is a safety tape with one breakaway point of another embodiment.
Figure 2C:
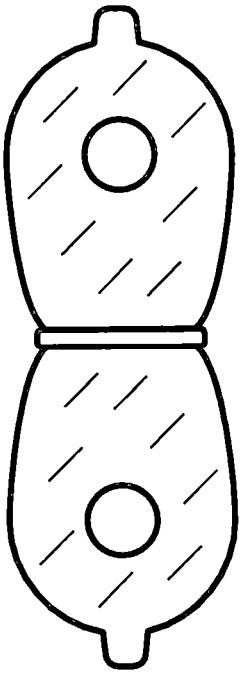
FIG. 2C is a safety tape with two breakaway points and a greater distance between the two punch holes of another embodiment.
Figure 2D:
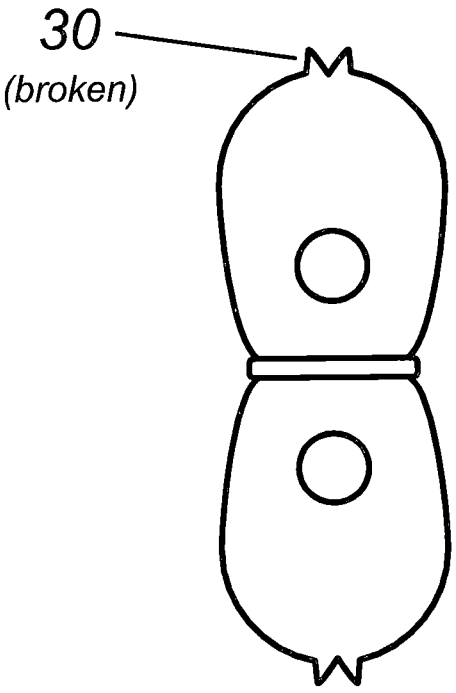
FIG. 2D is a safety tape with two broken breakaway points and a shorter distance between the two punch holes of another embodiment.

FIG. 2B shows a flat, unfolded, FIG. 8 shape safety tape (46) with one extended breakaway point (30) which, if broken, immediately indicates to in potential customer if the product has been opened or not. A flat, unfolded piece of safety tape (46) can be approximately one or two inches long, depending on the size of the plateau (22). The length can also vary depending on the tackiness of the tape itself, the strength necessary to hid the tape in place while the lid (14) is being opened, etc. Generally speaking, the larger the area covered with safety tape and the stronger the tackiness of tape, the better the tape holds its position while the lid (14) is first opened.

Figure 3:
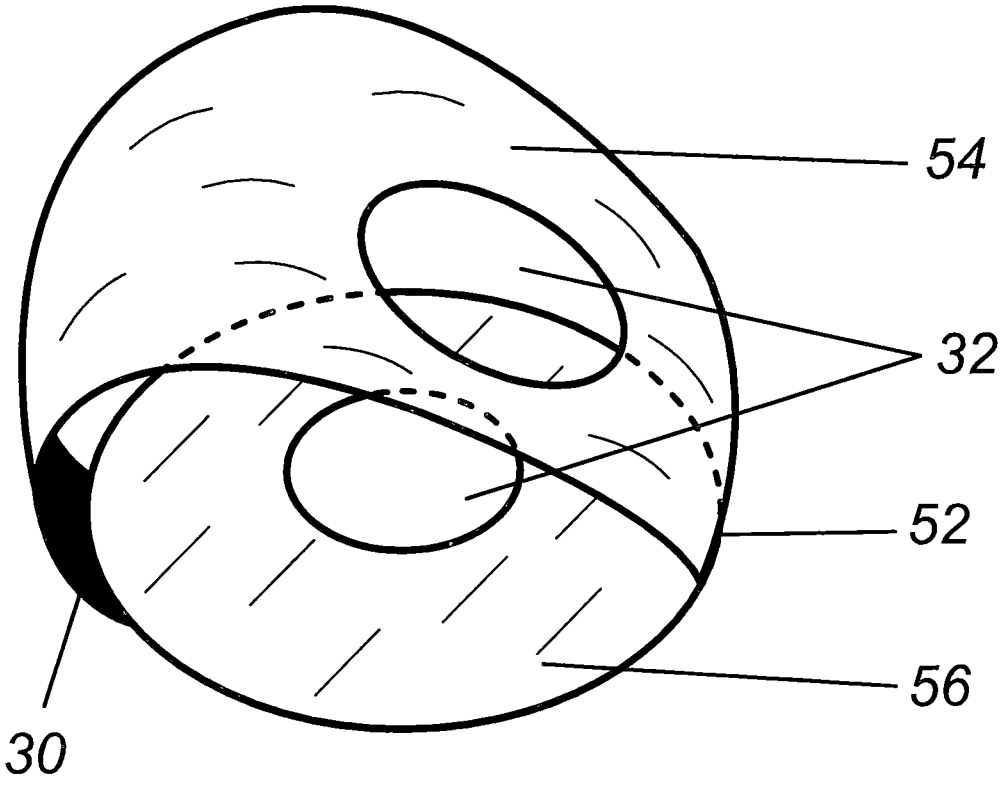
FIG. 3 is a side view of a folded safety tape.

FIG. 3 (side view) shows a folded safety tape (46) as it would appear inside a cap (12). One of the punch holes (32) would go around the cap spout (48) and the other punch hole (32) would go around the crater (20). Punch holes (32) are approximately 0.7 cm to 2 cm depending on the size of the crater (20) and cap spout (48) that they go around. On a flat, unfolded piece of safety tape (46), punch holes (32) are approximately half an inch to an inch and a half away from each other. The farther the punch holes (32) are away from one another, the wider the lid is allowed to open before the safety tape (46) becomes taut, and finally breaks. Therefore, the opposite is true. The shorter the distance between the punch holes means the lid does not open as wide before the safety tape (46) tears, thus, it is that much harder for t saboteur to try to put a foreign substance in through the cap spout (48). The tacky, sticky side (54) of the safety tape (46) is on the outer side, while the non-tacky, non-sticky side (56) is on the inner side of the tape.

Figure 4A:
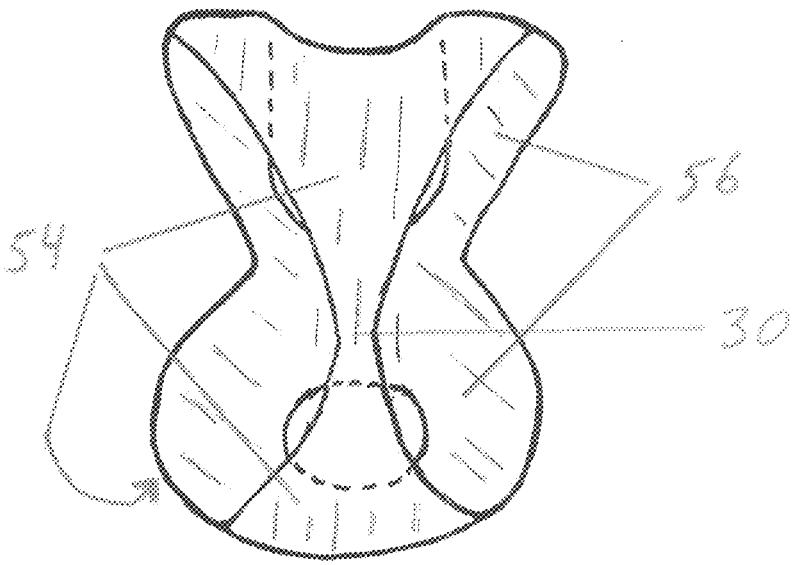
FIGS. 4A, 4B, and 4C are front views of various folded safety tapes with narrowed breakaway point(s).
Figure 4B:
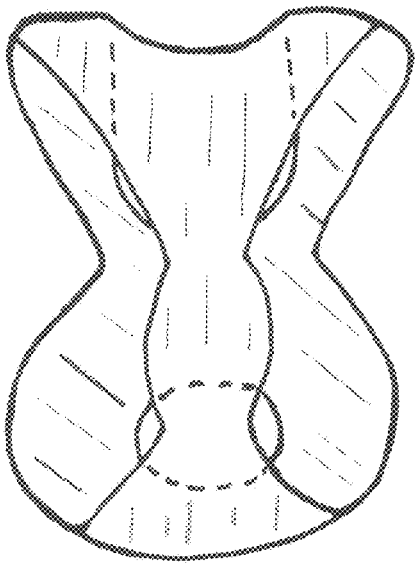
Figure 4C:
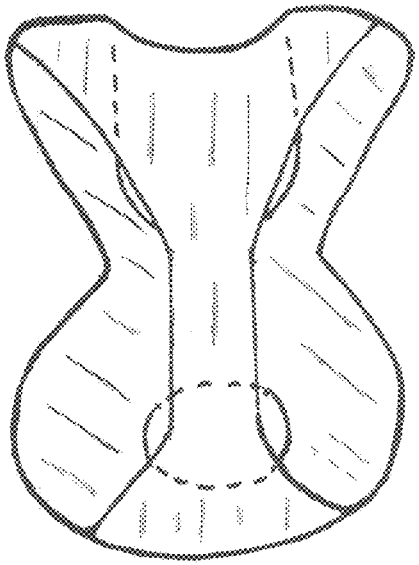
Figure 5A:
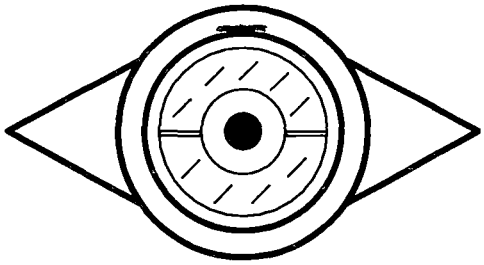
FIGS. 5A, 5B, 5C, and 5D are top views of various safety tape shapes and sizes as they sit on the plateau of collapsible tubes.

FIG. 4A (front view) shows a folded safety tape (46) with a narrow breakaway point (30). The breakaway point can be anywhere from approximately 0.25 cm to 2 cm or more. Generally speaking, the narrower the width at the breakaway point, the faster and easier it is for the safety tape to break apart. FIG. 5A (top view) shows a safety tape (46) completely surrounding the cap spout (48). FIG. 6B (side view) shows a broken safety tape (46) and a slightly ajar lid (14).

DETAILED DESCRIPTION OF THE INVENTION

The threadless tube (26), which is a member of the cap, is glued to the threadless body neck (50) by means of, perhaps, a heat-activated adhesive. As shown in FIG. 1A, there is not a male section screw-on thread system with an accepting female screw-on portion as is the case with many consumer products. This permanent connection of the cap (12) to the body (10) eliminates one main entry point to the product body for any potential saboteur.

A flat, unfolded safety tape (FIG. 2B) or a pre-folded safety tape (46), as shown in FIGS. 3 and 4A, is adhered to the underside of the lid (14) and to the top of the plateau (22). The sticky side (54) is on the outside and the non-sticky side (56) is on the inner side of the folded safety tape (46) which starts on the underside of the lid (14) near the hinge (18) and inner wall (60) of the lid (FIG. 1E). The tape continues towards the center where a punch hole (32) allows for the safety tape (46) to go over and/or around the crater (20) and continue on towards the front opening of the lid (14). A breakaway point (30), generally located at the midway point on the safety tape (46), is located just inside at the front of the lid (14). It is not mandatory that the tape is adhered to the inner wall (60) of the lid at this point, so it doesn't have to have a sticky substance in this section of the tape. The safety tape (46) drops down to and is adhered to, the plateau as it runs back toward the cap spout (48). Another punch hole allows the safety tape (46) to move over and/or around the cap spout (48) as it moves towards the hinge (18). It comes to a stop at the safety tape fold (52) near the edge of the plateau rim (24) just before the hinge (18). The safety tape (46) never leaves outside of the cap (12), and, is thus, self-contained and free from being sabotaged without being detected. The safety tape (46) is generally compressed with some slack while it is in its resting place. Once the lid (14) is opened for the first time, the safety tape (46) becomes taut until it reaches its breaking point and tears apart. The broken safety tape (46) indicates that someone has opened this container and it should not be purchased. The safety tape (46) is to adhere to the container until the lid has been opened and the safety tape (46) has been broken. Then, it peels off easily without leaving any residue.

As shown in FIG. 5A, only one section of the safety tape (46), the top section adhered to the underside of the lid (14), is visible from above through the clear lid (14). The remaining part of the safety tape (46) is hidden underneath this top section and is adhered to the plateau (22).

As shown in FIG. 6B, the lid (14) is open on the ajar cap (12) and the safety tape (46) has been broken, indicating the lid has been opened and that the customer should not purchase this item.

Figure 1B:
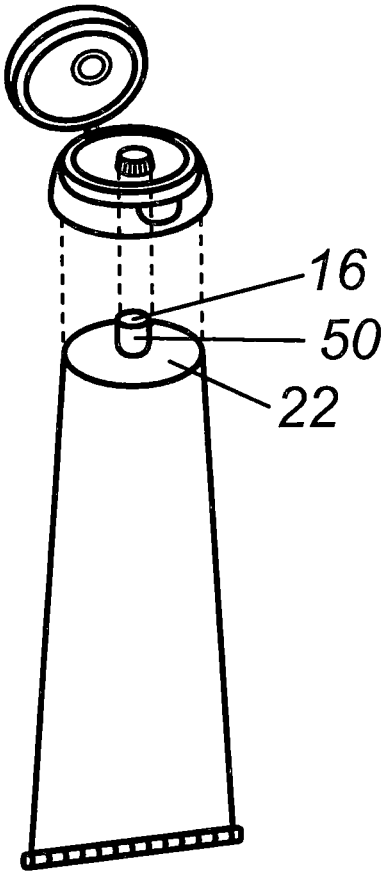
FIG. 1B is a tamper-evident container with a body neck on a flat body top of another embodiment.

FIG. 1B (front view) is shown with a body neck (50) and body spout (16) on the plateau (22).

Figure 1C:
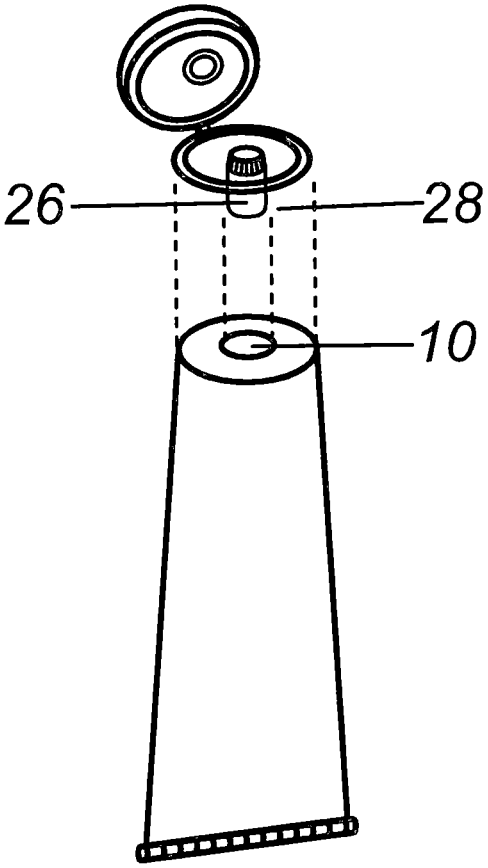
FIG. 1C is a tamper-evident container with footing and no spout on the body of another embodiment.

FIG. 1C (front view) is shown with footing (28) at the base of the tube (26) and no spout on the top of the body (10).

Figure 1D:
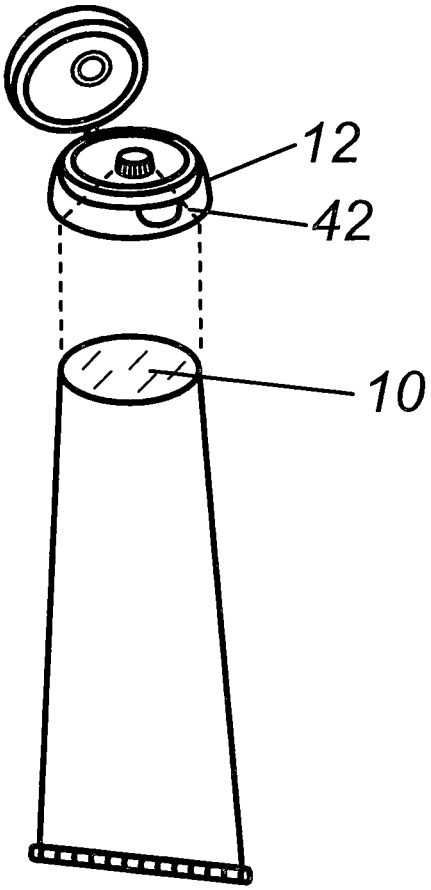
FIG. 1D is a tamper-evident container with sloping sides hidden within the cap that is sealed to the sides of a topless body of another embodiment.
Figure 1E:
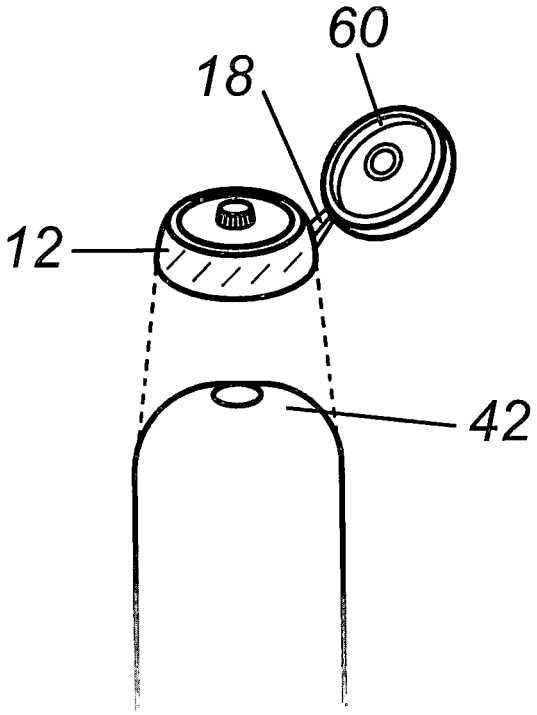
FIG. 1E is a tamper-evident container with a streamlined cap that is sealed to a slightly-sloped spoutless body of another embodiment.

FIG. 1D (front view) is shown a hidden body slope (42) within the cap (12) and a topless body (10).

FIG. 1E (front view) is shown with a hinge (18) connected to a streamlined cap (12) and a gradual sloping body slope (42). Also shown is the inner wall (60) of the lid.

Figure 5B:
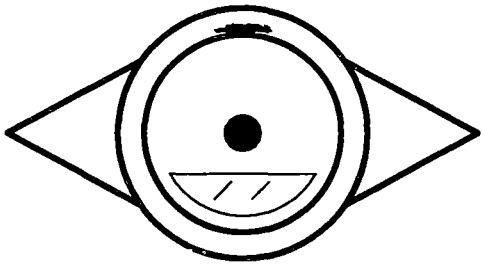
Figure 5C:
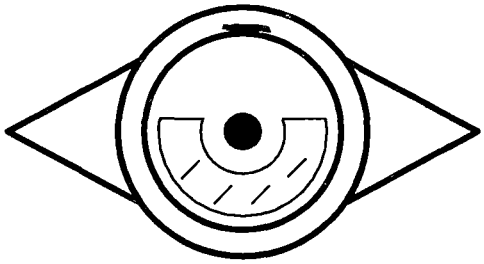
Figure 5D:
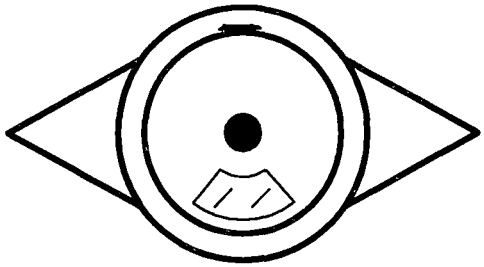

FIGS. 5B to 5D (top view) require less safety tape (46) covering a smaller area and accomplish the same goal of adhering to the lid (14) and plateau (22), but they would require a tape with a stronger tackiness due to the fact they would be spread over a smaller area.

Figure 6A:
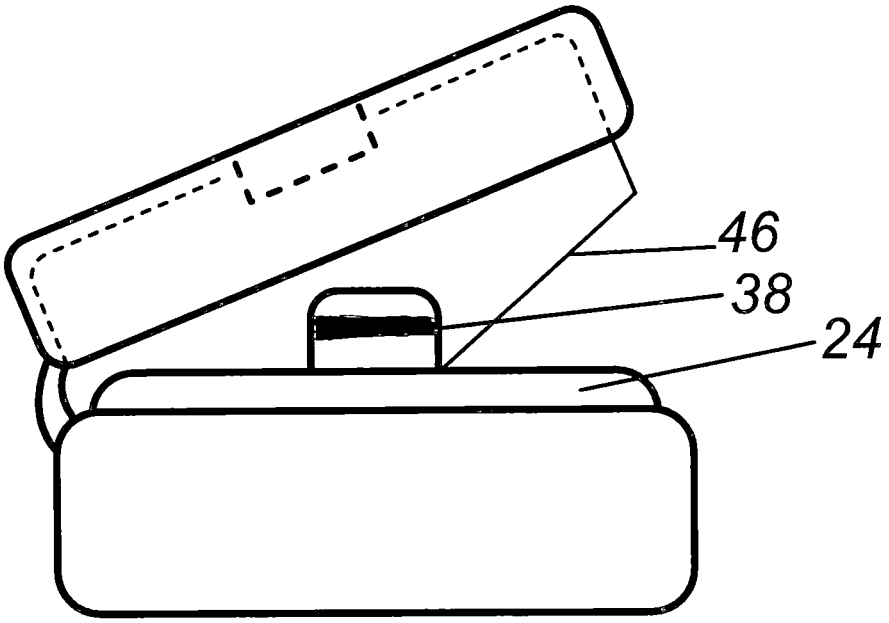
FIG. 6A is a side view of an ajar cap that shows the safety tape about to spring the taut safety shrink band of one embodiment.
Figure 6B:
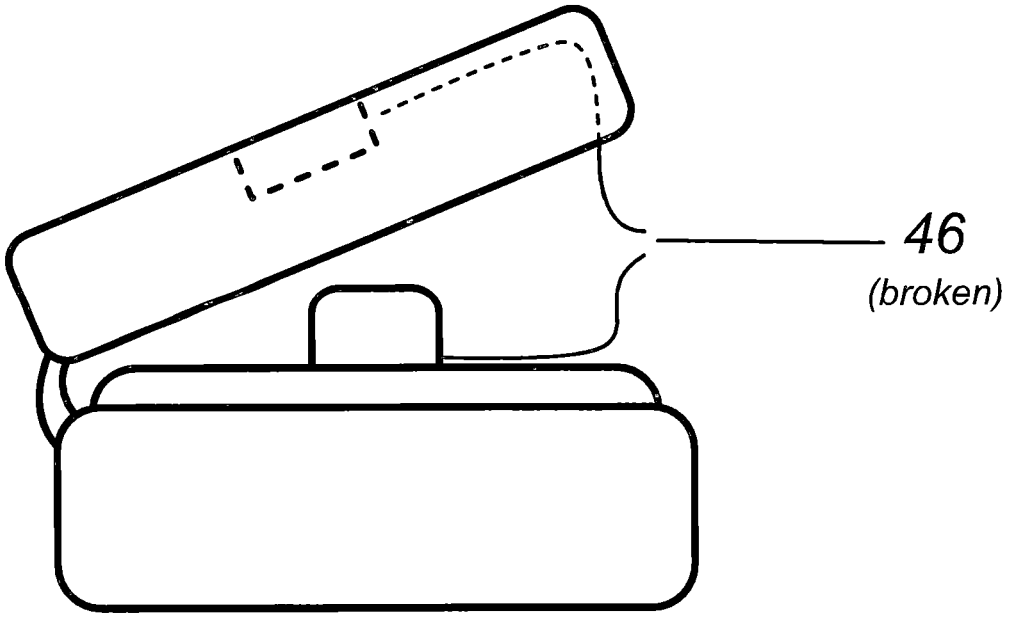
FIG. 6B is a side view of an ajar cap which shows the safety tape has been torn apart. The safety tape is only at the front half of the container as it does not go beyond the crater, nor the spout, of another embodiment.

FIG. 6A is a side view that shows a taut safety tape (46) which runs underneath a safety shrink band (40) and is about to pull up on the safety shrink band (40), which would tear it apart. An O-ring (38), or similar item, could be used in place of the safety shrink band (40) and would pop off once the tape is pulled up from underneath it. All of these would indicate that the lid (141) has been opened.

Figure 6C:
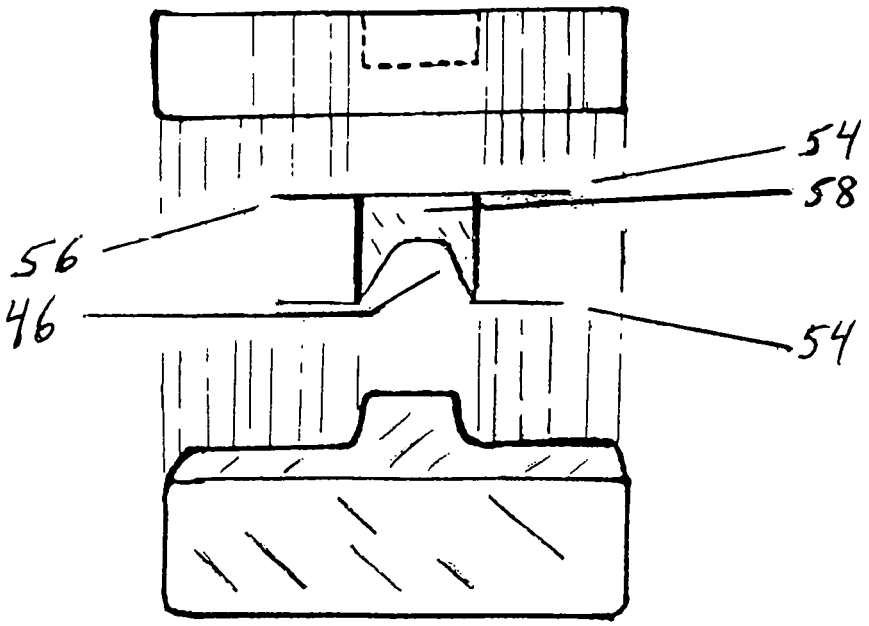
FIG. 6C is a front exploded view of a cap that shows a centrally-located slack safety tape, which covers the spout, within a cylinder-shaped safety tape sleeve.

FIG. 6C (exploded view) is shown with a safety tape sleeve (58) which will break when stretched too far. Also, a safety tape (46) is shown within the safety tape sleeve (58) which rests over the cap spout (48) to act as an extra layer of safety.

Figure 6D:
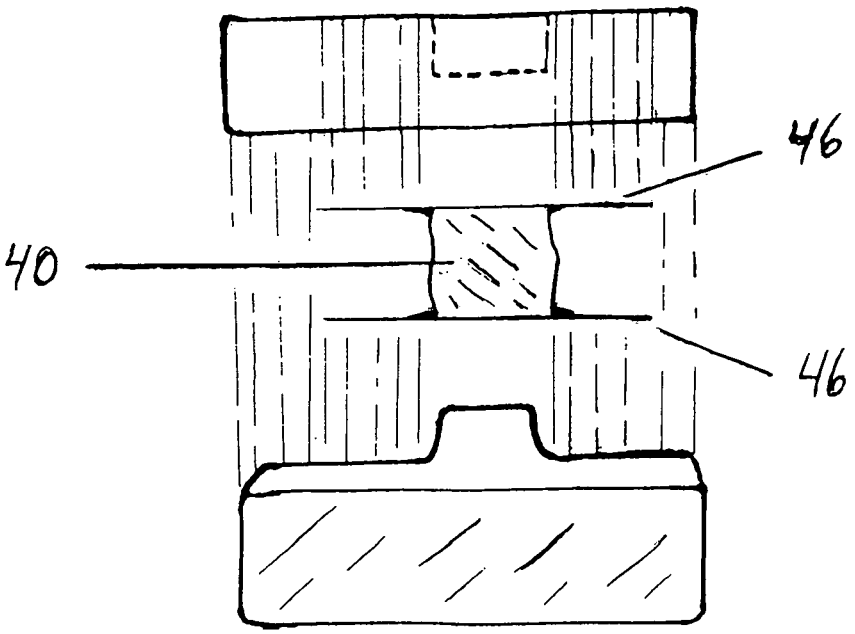
FIG. 6D is a front exploded view of a cap that shows safety tape as members on the top and bottom of a safety shrink band.

FIG. 6D (exploded view) is shown with a safety shrink band (40) which is connected to safety tape (46) on the top and bottom. The safety shrink band (40) pulls apart when stretched too far.

Figure 7A:
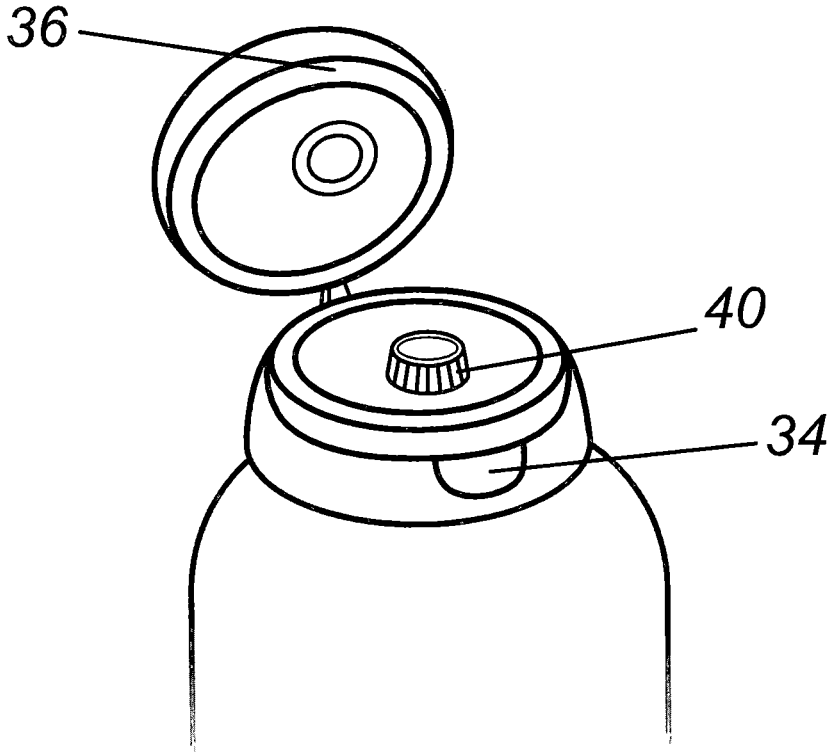
FIG. 7A is a front view of a tamper-evident container with the safety shrink band around a spout.

FIG. 7A (front view) is shown with the safety shrink band (40) around the cap spout (48). Illustrated on the outside of the cap are the thumb dent (34) and thumb overhang (36) which allow the consumer to easily open the lid (14).

Figure 7B:
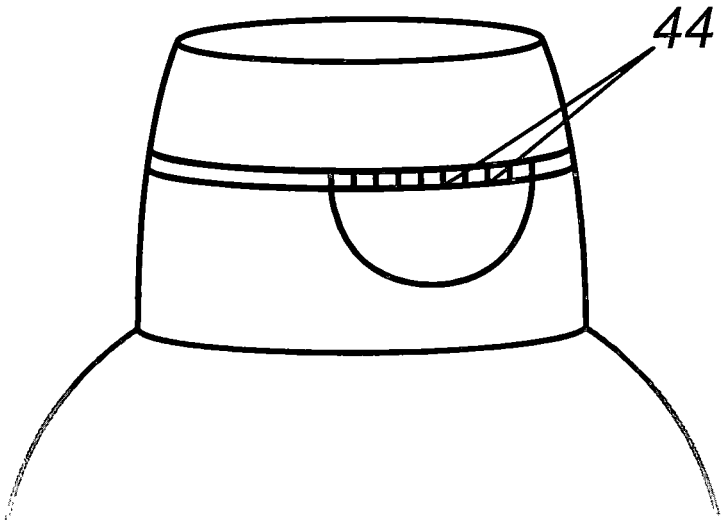
FIG. 7B is a front view of a closed tamper-evident container with scaled snap-off studs of one embodiment.

FIG. 7B (front view) is shown with snap off studs (44) which break apart to indicate when the lid (14) had been opened.

CONCLUSION, RAMIFICATIONS, AND SCOPE

Accordingly, the reader will see that the Truly Tamper-evident Containers of the various embodiments are a much safer packaging system for many everyday consumer products which will have the consumers confident to use, and the manufacturers confident to make without fear of lawsuits. These containers can be produced at a nominal cost to the manufacturers who may or may not, pass on the savings to the customer. In addition, previously used methods of using tape, safety shrink band, etc., outside the cap may still be utilized as an extra layer of confidence for the customer. There will be no more inconsistencies of products where some manufacturers use foil on the cap spouts, safety shrink bands or tamper-evident tape on the outside of their containers, etc., while others do not use any such safety protection at all. There would be no more being able to unscrew the cap from the container body and then putting a foreign substance in through the spout. No more not being able to see through the cap in order to see if the foil is on properly, been tampered with, etc. A reduction in the number of injuries, deaths, and lawsuits can be expected from these new tamper-evident containers.

There is no excuse for not having a universally-accepted product container where all product packaging contains the same or nearly the same, system whereby the customer can feel confident that the product they are purchasing has not been tampered with. By having a clear, see-through container cap permanently sealed to the container body, and a folded safety tape or similar item adhered inside the cap where no saboteur can have access to it without signally to the customer that the product has been tampered with, the public and manufacturers can feel confident that no one with nefarious intent will ever easily succeed.

While the above description contains specificities, they should not be construed as limitations on the scope, but instead, as an exemplification of one or more embodiments thereof. Many more variations are possible. For instance, the container may be in many different forms of packaging, in addition to collapsible tubes. The cap may be slightly tinted, colored, or opaque. The size and shape may be different to accommodate the size of the cap, the tackiness of the tape, the placement of the safety tape attached to the foil cover an the spout, the location of the spout and crater, etc. The breakaway point (s) may be narrower or wider or be made of a different material that may be more difficult or easier to break apart than the safety tape.

There are various possibilities with regard to how the cap is connected to the body, where and how the safety tape is set within the cap, how other items such as safety shrink bands, O-rings, or other items are used to show whether or not a container lid has been opened or tampered with, etc., therefore, the scope should be determined not by the illustrated embodiments, but by the claims and their legal equivalents.

I claim:

1. A tamper-evident container comprising:

a container body comprising: a screwless neck, spout, brim, or flanged top;

at container cap comprising a lid, an opening adjacent a front inner wall, a spout, a rear, hinged end, a crater on the underside of the lid, and a threadless tube that descends vertically from the container cap and which is permanently adhered to the screwless neck, spout, brim, or flanged top of the container body, and a tape adhered to an underside of the lid which extends away from the rear, hinged end of the container cap, towards the front inner wall of the lid, down to a plateau on the top of the container body, and back towards the spout and the rear, hinged end of the container cap;

wherein the tape breaks apart when the lid is opened for the first time to provide visual evidence of tampering.

2. The container of claim 1 wherein the container cap and the container body comprise polyethylene.

3. The container of claim 1 wherein the container cap and lid are clear or see-through.

4. The container of claim 1 wherein the spout is sealed with foil, paper, or plastic.

5. The container of claim 1 wherein the spout is ringed by an O-ring, a safety shrink band, a second tape, a plastic item, or a paper item that comes off or breaks apart when the tape being disposed underneath the O-ring, the safety shrink band, the second tape, the plastic item, or the paper item is pulled up when the lid is opened.

6. The container of claim 1 wherein the tape is further adhered to the inner wall of the lid at the opening.

7. The container of claim 1 wherein the tape is made of foil, paper, or plastic.

8. The container of claim 1 wherein the threadless tube on the container cap is permanently adhered to the screwless neck, spout, brim, or flanged top of the container body with a heat-activated adhesive.

9. The container of claim 1 wherein the container body is a collapsible tube.

10. The container of claim 1 wherein the lid is a flip-top lid.

11. The container of claim 1 wherein the tape is masking tape.

12. The container of claim 1 wherein the tape is attached to or is a member of foil, paper, or plastic material further covering the spout.

13. The container of claim 1 wherein the tape is a cylindrical sleeve.

14. The container of claim 13 wherein the cylindrical sleeve is made of foil, paper, or plastic material.

15. The container of claim 13 wherein the cylindrical sleeve descends from the crater down to the spout on the plateau.

16. A method of joining a tape having a first end, an opposite end, and a sticky side to a product packaging container comprising a container body, and a container cap having a lid, a front, an opening, and a plateau, comprising the steps of: placing the first end of the tape with the sticky side onto an underside of the lid, near a rear, hinged end of the container cap, pressing the tape against the lid as the tape runs toward a front end of the container cap guiding a first punch hole in the tape around a crater descending from the underside of the lid, and continuing to press the tape against the lid until the tape reaches the front end of the lid near the opening; lifting an opposite end of the tape back to the rear, hinged end of the container cap while lining up a second punch hole in the tape to be able to go around a spout on the plateau; setting the first end of the tape with the sticky side facing down onto the plateau; closing the lid which lowers the tape, so that the tape settles around the second punch hole and squats in a resting position sticking to the plateau.

* * * * *